US011361662B2

(12) United States Patent
Hammad et al.

(10) Patent No.: US 11,361,662 B2
(45) Date of Patent: Jun. 14, 2022

(54) PARKING INDICATOR COMPRISING INDICATOR RETRACTING MECHANISM

(71) Applicant: Saudi Arabian Oil Company, Dhahran (SA)

(72) Inventors: Ahmad D. Hammad, Dhahran (SA); Faisal S. Aljar, Khobar (SA); Issam T. Amr, Khobar (SA); Bandar Fadhel, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 1127 days.

(21) Appl. No.: 15/921,985

(22) Filed: Mar. 15, 2018

(65) Prior Publication Data

US 2019/0287399 A1 Sep. 19, 2019

(51) Int. Cl.
*E01F 9/00* (2016.01)
*G08G 1/14* (2006.01)
(Continued)

(52) U.S. Cl.
CPC ..... *G08G 1/142* (2013.01); *E01F 9/65* (2016.02); *E04H 6/426* (2013.01)

(58) Field of Classification Search
CPC ..... E01F 9/65; E04H 6/426
See application file for complete search history.

(56) References Cited

U.S. PATENT DOCUMENTS 2,737,740 A 3/1956 Genoe
2,784,692 A * 3/1957 Ballesteros ..... E01F 9/65 116/303
(Continued)

FOREIGN PATENT DOCUMENTS

BR 202014014625 U2 8/2016
CN 208069448 U * 11/2018
(Continued)

OTHER PUBLICATIONS

Examination Report dated Feb. 14, 2021 pertaining to GCC Application No. GC 2019-37169 filed Mar. 13, 2019.
(Continued)

*Primary Examiner* — Thomas B Will
*Assistant Examiner* — Katherine J Chu
(74) *Attorney, Agent, or Firm* — Dinsmore & Shohl, LLP

(57) ABSTRACT

Embodiments of this disclosure are directed to a parking indicator comprising a vehicle contact body, a pivoting contact body support, an elongated visibility indicator, an indicator actuating mechanism, and an indicator retracting mechanism. The pivoting contact body support is attached to the vehicle contact body and is configured to permit the vehicle contact body to pivot to a horizontally-oriented position when the vehicle contact body is grounded via the pivoting contact body support and is contacted by a vehicle entering a parking space occupied by the parking indicator. The elongated visibility indicator is mechanically coupled to the vehicle contact body via the indicator actuating mechanism such that the indicator actuating mechanism upholds the elongated visibility indicator in an extended position. The indicator retracting mechanism is configured to retract the elongated visibility indicator to a retracted position when the vehicle contact body pivots from the vertically-oriented position to the horizontally-oriented position.

19 Claims, 4 Drawing Sheets

(51) Int. Cl.
*E04H 6/42* (2006.01)
*E01F 9/65* (2016.01)

(56) References Cited

U.S. PATENT DOCUMENTS

| | | | | | |
|---|---|---|---|---|---|
| 4,137,662 | A * | 2/1979 | Baumer | E01F 9/627 | 40/608 |
| 4,565,466 | A * | 1/1986 | Daggs | E01F 9/627 | 40/608 |
| 4,934,097 | A * | 6/1990 | Quante | E01F 13/085 | 404/6 |
| 6,275,169 | B1 | 8/2001 | Krygler et al. | | |
| 7,106,214 | B2 | 9/2006 | Jesadanont et al. | | |
| 2002/0043025 | A1 * | 4/2002 | Zayas | E01F 9/681 | 49/33 |
| 2006/0253226 | A1 | 11/2006 | Mendelson | | |

FOREIGN PATENT DOCUMENTS

| | | | |
|---|---|---|---|
| DE | 202009014567 | U1 | 12/2010 |
| GB | 2387705 | A | 10/2003 |
| JP | H1054298 | A | 2/1998 |

OTHER PUBLICATIONS

Green Car Reports, "Korean Oil Company Helps Drivers Save Gas With. . . Parking Baloons?", http://www.greencarreports.com/news/1085980_korean-oil-company-helps-drivers-save-....

International Search Report and Written Opinion dated May 24, 2019 pertaining to International application No. PCT/US2019/021537 filed Mar. 11, 2019, 13 pgs.

* cited by examiner

PARKING INDICATOR COMPRISING INDICATOR RETRACTING MECHANISM

BACKGROUND

The present disclosure relates to parking indicators for motor vehicles. More specifically, it relates to a visual parking indicator that allows vehicle drivers searching for a parking space in a parking lot or garage to determine if a parking space is unoccupied from afar.

BRIEF SUMMARY

According to the subject matter of the present disclosure, parking indicators lower carbon dioxide emissions from vehicles by enabling drivers to quickly identify unoccupied parking spaces and thereby reduce traffic and time spent moving in parking lots. Parking indicators that do not require additional infrastructure or electrical installation may be quickly and efficiently installed in existing parking lots.

In accordance with one embodiment of the present disclosure, a parking indicator comprising a vehicle contact body, a pivoting contact body support, an elongated visibility indicator, an indicator actuating mechanism, and an indicator retracting mechanism is disclosed. The pivoting contact body support is attached to the vehicle contact body and is configured to permit the vehicle contact body to pivot to a horizontally-oriented position when the vehicle contact body is grounded via the pivoting contact body support and is contacted by a vehicle entering a parking space occupied by the parking indicator. The pivoting contact body support and the vehicle contact body collectively define a grounded contact body height h that is sufficient to ensure that a vehicle moving across a parking indicator position will contact the vehicle contact body when the vehicle contact body is grounded via the pivoting contact body support in a vertically-oriented position. The elongated visibility indicator is mechanically coupled to the vehicle contact body via the indicator actuating mechanism such that the indicator actuating mechanism upholds the elongated visibility indicator in an extended position, at a height that it is sufficient for substantially unobstructed vehicular viewing when the vehicle contact body is grounded via the pivoting contact body support in the vertically-oriented position. The indicator retracting mechanism is configured to retract the elongated visibility indicator from the extended position to a retracted position when the vehicle contact body pivots from the vertically-oriented position to the horizontally-oriented position.

In accordance with another embodiment of the present disclosure, a parking indicator comprising a vehicle contact body, a pivoting contact body support, an elongated visibility indicator, an indicator actuating mechanism, and an indicator retracting mechanism is disclosed. The vehicle contact body is configured with the pivoting contact body support to move from an unoccupied parking space position to an occupied parking space position when grounded in a parking space and contacted by a vehicle. The elongated visibility indicator is mechanically coupled to the vehicle contact body and configured with the indicator actuating mechanism and the indicator retracting mechanism to move between an extended position and a retracted position when the vehicle contact body moves between the unoccupied parking space position and the occupied parking space position. The extended position of the elongated visibility indicator is characterized by a grounded height that is sufficient for substantially unobstructed vehicular viewing when the vehicle contact body is in the unoccupied parking space position.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
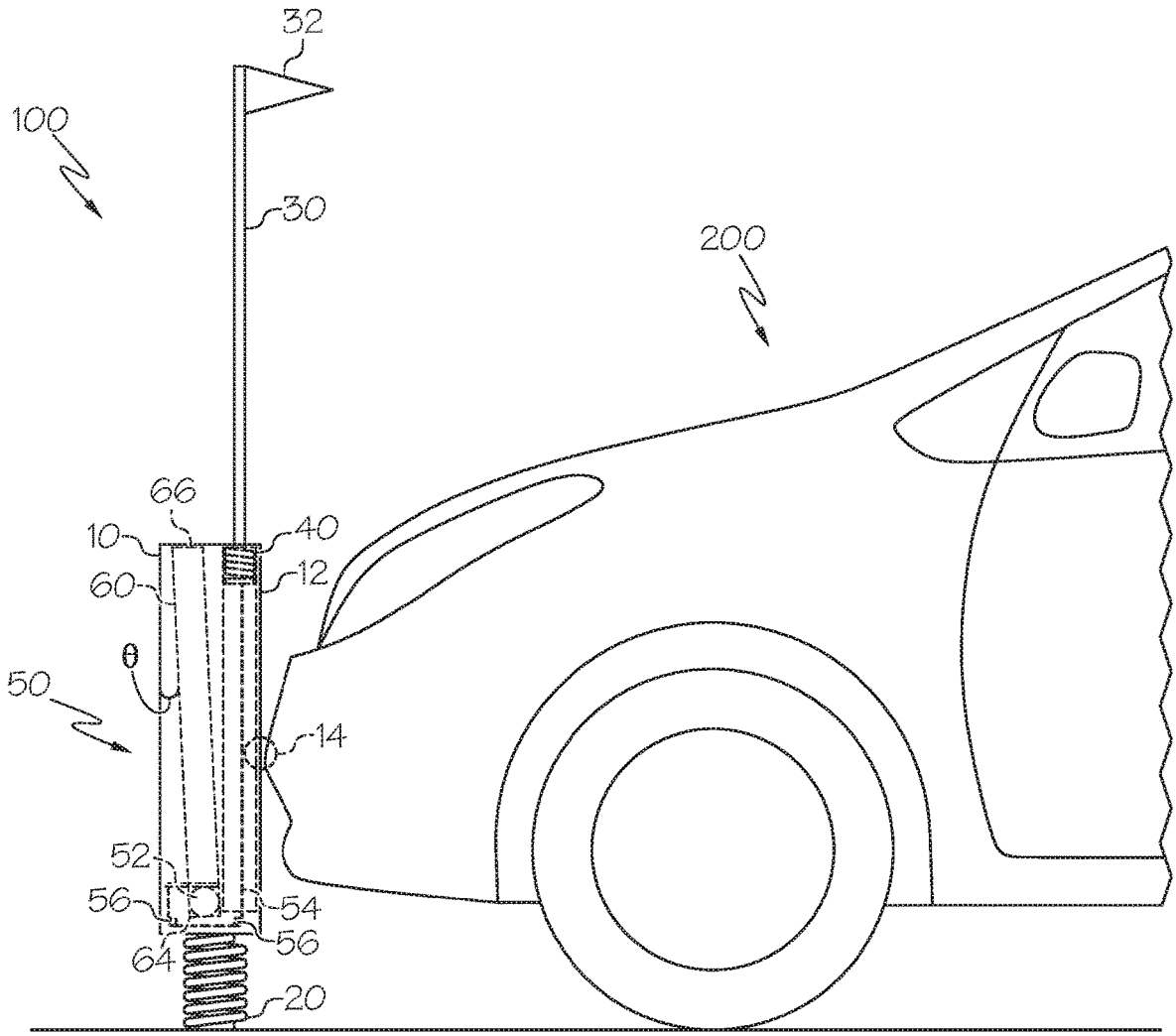
FIG. 1 illustrates a parking indicator and vehicle, according to one or more embodiments described in this disclosure.
Figure 3:
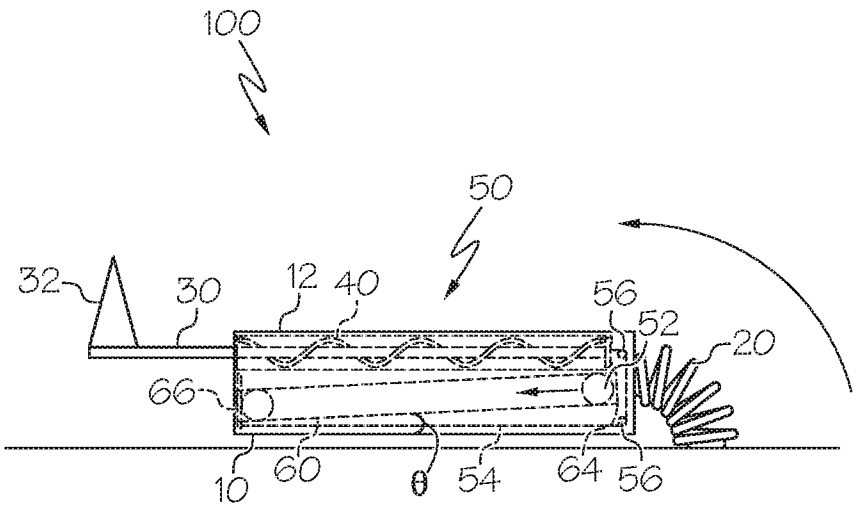
FIG. 3 illustrates a parking indicator in a horizontally-oriented position, according to one or more embodiments described in this disclosure.
Figure 2:
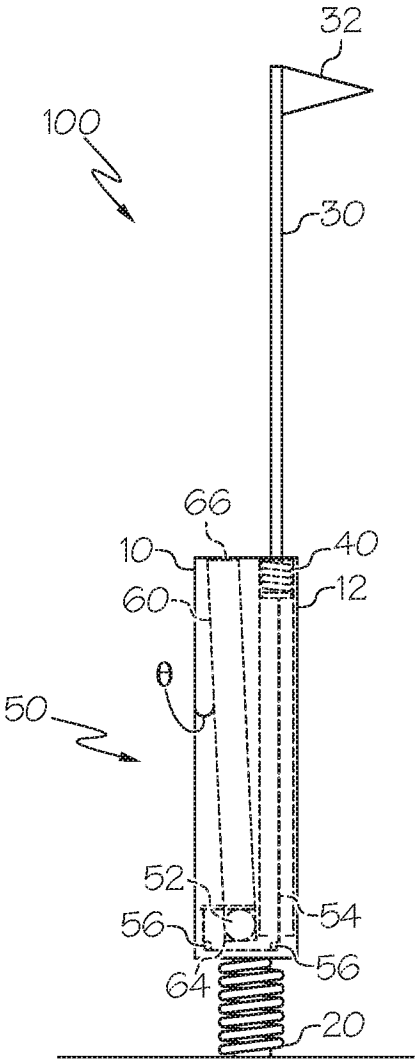
FIG. 2 illustrates a parking indicator in a vertically-oriented position, according to one or more embodiments described in this disclosure.

Referring initially to FIGS. 1-3, a parking indicator 100 is shown. The parking indicator 100 comprises a vehicle contact body 10, a pivoting contact body support 20, an elongated visibility indicator 30, an indicator actuating mechanism 40, and an indicator retracting mechanism 50. The pivoting contact body support 20 is attached to the vehicle contact body 10 and is configured to permit the vehicle contact body 10 to pivot from a vertically-oriented position, which is illustrated in FIGS. 1-2, to a horizontally-oriented position, which is illustrated in FIG. 3, when the vehicle contact body 10, grounded in the vertically-oriented position via the pivoting contact body support 20, is contacted by a vehicle 200 entering a parking space occupied by the parking indicator 100. The pivoting contact body support 20 is strong enough to ground the vehicle contact body 10 in the vertically-oriented position, but is flexible enough to permit the vehicle contact body 10 to move into the horizontally-oriented position when a vehicle 200 exerts force on the vehicle contact body 10. In most applications, the pivoting contact body support 20, although biased towards the vertical, should not biased with so much force that the vehicle contact body 10 would damage the vehicle 200 when the vehicle enters the parking space and contacts the vehicle contact body 10.

Figure 5:
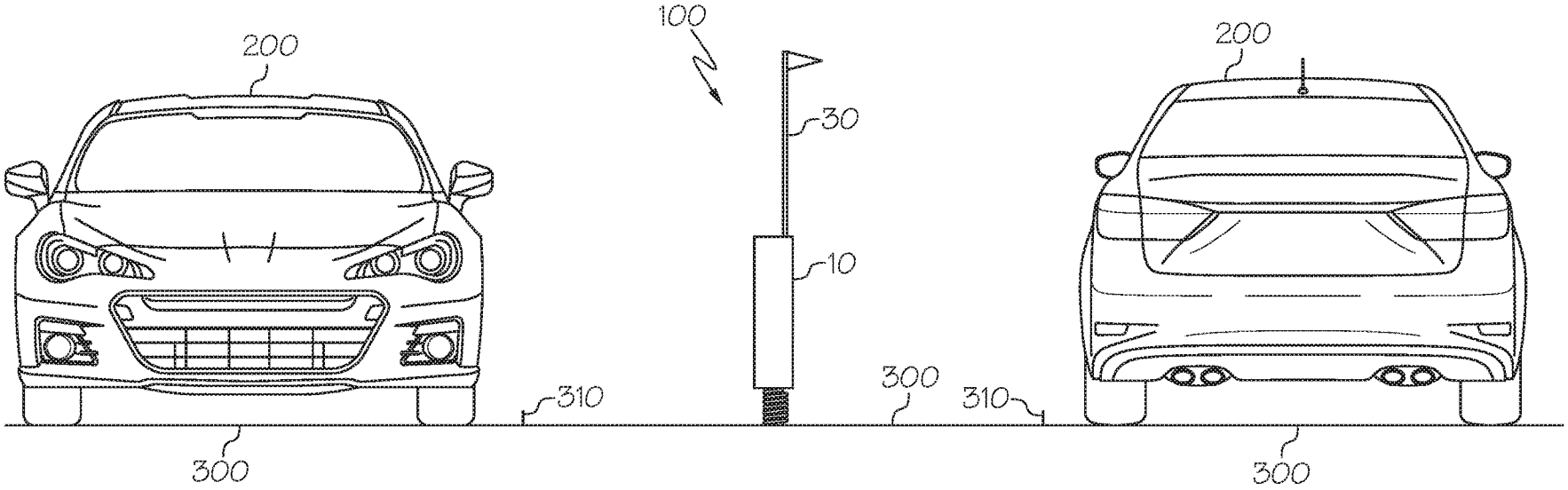
FIG. 5 illustrates a parking indicator in an unoccupied parking space and two surrounding occupied parking spaces, according to one or more embodiments described in this disclosure.

Referring to FIGS. 1-2, the pivoting contact body support 20 and the vehicle contact body 10 collectively define a grounded contact body height h that is sufficient to ensure that a vehicle 200 moving across a parking indicator position will contact the vehicle contact body 10 when the vehicle contact body 10 is grounded via the pivoting contact body support 20 in the vertically-oriented position. The elongated visibility indicator 30 is mechanically coupled to the vehicle contact body 10 via the indicator actuating mechanism 40, which may comprise a spring, such that the indicator actuating mechanism 40 upholds the elongated visibility indicator 30 in an extended position, at a height that it is sufficient for substantially unobstructed vehicular viewing when the vehicle contact body 10 is grounded via the pivoting contact body support 20 in the vertically-oriented position. When the parking indicator 100 is in the vertically-oriented position, the elongated visibility indicator 30 is at a height that it is sufficient for substantially unobstructed vehicular viewing, meaning it is viewable from a standard-sized vehicle 200 moving through a parking lot, from a majority of positions in the parking lot, when other standard-sized vehicles are parked in, or moving through, the parking lot. For example, it will often be desirable to make sure the elongated visibility indicator 30 is viewable throughout the parking aisles, at the ends of the parking aisles, at parking lot entrances, at parking lot exits, or combinations thereof. FIG. 5 illustrates the height of the elongated visibility indicator 30 relative to the height of the surrounding parked vehicles 200.

Referring to FIGS. 1-3, the indicator retracting mechanism 50, which may be enclosed by a housing, is configured to retract the elongated visibility indicator 30 from the extended position to a retracted position when the vehicle contact body 10 pivots from the vertically-oriented position to the horizontally-oriented position. The retracted position, as shown in FIG. 3, is a position in which at least a portion of the elongated visibility indicator 30 is withdrawn from the height that is sufficient for substantially unobstructed vehicular viewing. The elongated visibility indicator 30 may be retracted behind or into the vehicle contact body 10.

Referring to FIGS. 1-3, in one embodiment, the indicator retracting mechanism 50 comprises one or more retraction pulleys 56 that are mechanically coupled to the vehicle contact body 10, an indicator displacement mass 52, and a tensile retracting link 54. The indicator displacement mass 52 is mechanically coupled to the elongated visibility indicator 30 via the tensile retracting link 54, and the tensile retracting link 54 undergoes a directional tensile force transfer at the retraction pulleys 56 so as to define a folded tensile path extending from the indicator displacement mass 52 to the elongated visibility indicator 30. The tensile retracting link 54 is capable of transferring force sufficient to move the elongated visibility indicator 30 without breaking. The tensile retracting link 54 may be presented in a variety of forms, such as a cable, a cord, a band, a chain, a wire, a rope, a string, a strap, a belt, or any object that mechanically couples the elongated visibility indicator 30 to the indicator displacement mass 52 and permits the aforementioned directional tensile force transfer at the retraction pulleys 56 so as to define the folded tensile path extending from the indicator displacement mass 52 to the elongated visibility indicator 30.

The parking indicator 100 may further comprise a displacement mass guide 60 mechanically coupled to the vehicle contact body 10 such that the displacement mass guide 60 and a vehicle contact face 12 of the vehicle contact body 10 are non-parallel and define an angle of declination θ there between. The angle of declination θ may be at least about 10° to encourage the aforementioned retraction under a variety of conditions. The angle of declination θ may be created by either designing the vehicle contact face 12 such that it is tilted forward towards the parking space, from the vertical, when the vehicle contact body 10 is in the vertically-oriented position, by designing the displacement mass guide 60 so that it is tilted rearward when the vehicle contact body 10 is in the vertically-oriented position, or by a combination of both. The Figures depict the second embodiment in which the displacement mass guide 60 is tilted rearward within the vertically-oriented vehicle contact body 10. In this embodiment, the indicator displacement mass 52 rests on the first end 64 of the displacement mass guide 60 when the vehicle contact body 10 is in the vertically-oriented position. When the vehicle contact body 10 is in the horizontally-oriented position, gravity moves the indicator displacement mass 52 towards the second end 66 of the displacement mass guide 60 due to the angle of declination θ.

The indicator retracting mechanism 50 and the vehicle contact body 10 may be configured such that the indicator displacement mass 52 moves from a first end 64 of the displacement mass guide 60 to an opposite second end 66 of the displacement mass guide 60 when the vehicle contact body 10 moves from the vertically-oriented position to the horizontally-oriented position. The indicator displacement mass 52 may be any movable weighted object that has a mass sufficient to retract the elongated visibility indicator 30 when the vehicle contact body 10 moves from the vertically-oriented position to the horizontally-oriented position. As one nonlimiting example, the indicator displacement mass 52 may be a steel ball. In this manner, the displacement mass pulls the tensile retracting link 54, which retracts the elongated visibility indicator 30 into the vehicle contact body 10. Similarly, it is possible that the indicator retracting mechanism 50 and the vehicle contact body 10 may be configured such that the indicator displacement mass 52 moves from a second end 66 of the displacement mass guide 60 to an opposite first end 64 of the displacement mass guide 60 when the vehicle contact body 10 moves from the horizontally-oriented position to the vertically-oriented position. In this manner, the indicator displacement mass 52 moves the tensile retracting link 54 and the indicator actuating mechanism 40 raises the elongated visibility indicator 30.

The elongated visibility indicator 30 may be configured with the indicator retracting mechanism 50 such that at least about 80% of a length of the elongated visibility indicator 30 retracts when the vehicle contact body 10 pivots between the vertically-oriented position and the horizontally-oriented position. The elongated visibility indicator 30 may be configured with the indicator retracting mechanism 50 such that between about 80% and about 100% of a length of the elongated visibility indicator 30 retracts when the vehicle contact body 10 pivots between the vertically-oriented position and the horizontally-oriented position.

Figure 4:
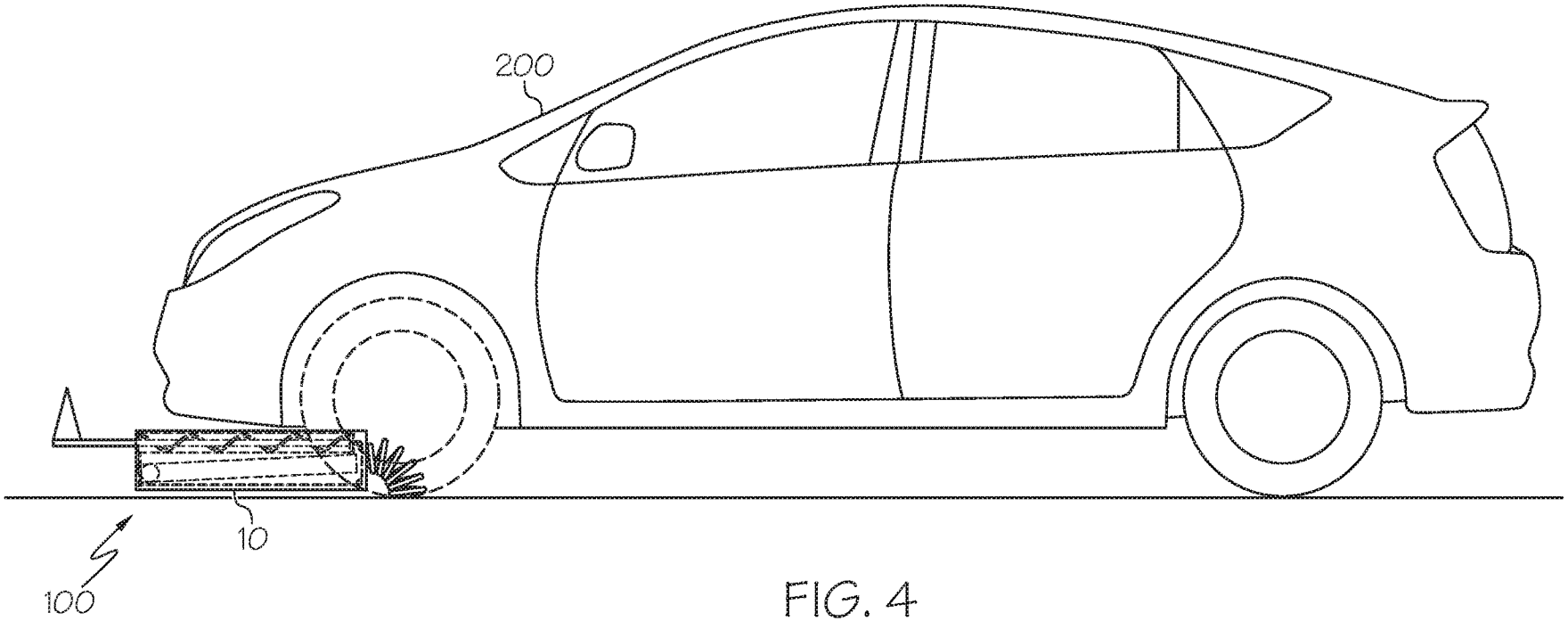
FIG. 4 illustrates a parking indicator in a horizontally-oriented position beneath a vehicle, according to one or more embodiments described in this disclosure.

The vehicle contact body 10 may be provided in a variety of shapes and forms. For example, and not by way of limitation, the vehicle contact body 10 may be flat or cylindrically shaped and may be made of soft, nonabrasive, damage-free materials such that a vehicle 200 will not be scratched, dented, or otherwise damaged, upon contact. These materials may be metal, plastic, wood, or any other suitable material, as nonlimiting examples. The vehicle contact body 10 may have a smooth profile in all directions, and can be designed so as not to include any protrusions that would impede contact between the vehicle 200 and the vehicle contact body 10. Additionally, the vehicle contact body 10 may rest below the vehicle 200 when in the horizontally-oriented position, as illustrated in FIG. 4. Referring to FIGS. 1-3, the vehicle contact body 10 may further comprise a vehicle contact face 12. In many cases, it may be advantageous to ensure that the vehicle contact face 12 is free of obstructive discontinuities. These obstructive discontinuities may, as nonlimiting examples, comprise an un-rounded head of a nut or bolt, or other hardware or surface irregularities that would obstruct the sliding progression of a vehicle bumper, or other vehicular surface, along the vehicle contact body 10 as the vehicle 200 moves over the parking indicator 100. It is possible that all or a portion of the vehicle contact face 12 may be formed from a flexible foam, cushioned, or rubberized material, as nonlimiting examples. Referring to FIG. 1, in some instances it may be advantageous to ensure that at least a vehicle contact point 14, which is the point on the vehicle contact face 12 at which a vehicle 200 would contact the vehicle contact body 10, is configured to yield to contact pressure when contact with a vehicle 200 is initiated and causes the vehicle contact body 10 to move from the vertically-oriented position to the horizontally-oriented position.

Referring to FIGS. 1-3, the pivoting contact body support 20 can be provided in a variety of forms. For example, the pivoting contact body support 20 may comprise a grounding support spring with an omni-directional pivoting axis. As another nonlimiting example, the pivoting contact body support 20 comprises a grounding support hinge with a uni-directional pivoting axis. This grounding support hinge may further comprise a spring-loaded hinge with a uni-directional pivot that is designed such that the vehicle contact body 10 moves from a vertically-oriented position to a horizontally oriented position in only one direction, about a single pivoting axis. In this configuration, the vehicle contact body 10 will maintain an orientation that is parallel to the parking lines 310 of the parking space 300 in which it is positioned (as illustrated in FIG. 5), when moving from the vertically-oriented position to the horizontally-oriented position (as illustrated in FIGS. 2 and 3), regardless of the angle at which an approaching vehicle 200 contacts the vehicle contact body 10. In another embodiment, the pivoting contact body support 20 comprises a mechanical stop that is configured to limit pivoting between the vertically and horizontally-oriented positions. It is possible that the vehicle contact body 10 will not continue past an angle perpendicular to the ground, ensuring that the vehicle contact body 10 will not contact a vehicle 200 past this perpendicular angle.

The elongated visibility indicator 30 may comprise a pole, a rod, a bar, a stick, or any element suitable for maintaining an upright extended position over an extended period of time. In one embodiment, the elongated visibility indicator 30 comprises a flag 32. The flag 32 defines an additional dimension of visibility on the elongated visibility indicator 30 and may be rigid or flexible. The flag 32 may comprise colors or other appealing characteristics such as, but not limited to, lights, reflectors, or designs that draw attention to the flag 32.

The indicator actuating mechanism 40, which may comprise a spring, is configured to return the elongated visibility indicator 30 to the extended position from the retracted position when the vehicle contact body 10 pivots from the horizontally-oriented position to the vertically-oriented position. The indicator actuating mechanism 40 may be further configured to keep the indicator retraction mechanism in tension as the vehicle contact body 10 pivots from the horizontally-oriented position to the vertically-oriented position and enables the elongated visibility indicator 30 to retract when the vehicle contact body 10 pivots from the vertically-oriented position to the horizontally-oriented position.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is possible that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A parking indicator comprising:

a vehicle contact body;

a pivoting contact body support;

an elongated visibility indicator;

an indicator actuating mechanism; and an indicator retracting mechanism, wherein the pivoting contact body support is attached to the vehicle contact body and is configured to permit the vehicle contact body to pivot to a horizontally-oriented position when the vehicle contact body is grounded via the pivoting contact body support and is contacted by a vehicle entering a parking space occupied by the parking indicator, the pivoting contact body support and the vehicle contact body collectively define a grounded contact body height h that is sufficient to ensure that a vehicle moving across a parking indicator position will contact the vehicle contact body when the vehicle contact body is grounded via the pivoting contact body support in a vertically-oriented position, the elongated visibility indicator is mechanically coupled to the vehicle contact body via the indicator actuating mechanism such that the indicator actuating mechanism upholds the elongated visibility indicator in an extended position, at a height that it is sufficient for substantially unobstructed vehicular viewing when the vehicle contact body is grounded via the pivoting contact body support in the vertically-oriented position, and the indicator retracting mechanism is configured to retract the elongated visibility indicator from the extended position to a retracted position when the vehicle contact body pivots from the vertically-oriented position to the horizontally-oriented position.

2. The parking indicator of claim 1 wherein:

the indicator retracting mechanism comprises a retraction pulley mechanically coupled to the vehicle contact body, an indicator displacement mass, and a tensile retracting link;

the indicator displacement mass is mechanically coupled to the elongated visibility indicator via the tensile retracting link; and the tensile retracting link undergoes a directional tensile force transfer at the retraction pulley so as to define a folded tensile path extending from the indicator displacement mass to the elongated visibility indicator.

3. The parking indicator of claim 2 wherein the parking indicator comprises a displacement mass guide mechanically coupled to the vehicle contact body such that the displacement mass guide and a vehicle contact face of the vehicle contact body are non-parallel and define an angle of declination there between.

4. The parking indicator of claim 3 wherein the angle of declination is at least about 10°.

5. The parking indicator of claim 3 wherein:

the indicator retracting mechanism and the vehicle contact body are configured such that the indicator displacement mass moves from a first end of the displacement mass guide to an opposite second end of the displacement mass guide when the vehicle contact body moves from the vertically-oriented position to the horizontally-oriented position; and the indicator retracting mechanism and the vehicle contact body are configured such that the indicator displacement mass moves from a second end of the displacement mass guide to an opposite first end of the displacement mass guide when the vehicle contact body moves from the horizontally-oriented position to the vertically-oriented position.

6. The parking indicator of claim 1 wherein the elongated visibility indicator is configured with the indicator retracting mechanism such that at least about 80% of a length of the elongated visibility indicator retracts when the vehicle contact body pivots between the vertically-oriented position and the horizontally-oriented position.

7. The parking indicator of claim 1 wherein the height at which the elongated visibility indicator is upheld is sufficient for substantially unobstructed vehicular viewing from parking aisles, at ends of the parking aisles, at parking lot entrances, at parking lot exits, or combinations thereof.

8. The parking indicator of claim 1 wherein the elongated visibility indicator is configured with the indicator retracting mechanism such that between about 80% and about 100% of a length of the elongated visibility indicator retracts when the vehicle contact body pivots between the vertically-oriented position and the horizontally-oriented position.

9. The parking indicator of claim 1 wherein the vehicle contact body comprises a vehicle contact face comprising a vehicle contact point that is configured to yield to contact pressure when contact with a vehicle causes the vehicle contact body to move from the vertically-oriented position to the horizontally-oriented position.

10. The parking indicator of claim 1 wherein the vehicle contact body comprises a housing that encloses the indicator retracting mechanism.

11. The parking indicator of claim 1 wherein the vehicle contact body comprises a vehicle contact face that is free of obstructive discontinuities.

12. The parking indicator of claim 1 wherein the pivoting contact body support comprises a grounding support spring with an omni-directional pivoting axis.

13. The parking indicator of claim 1 wherein the pivoting contact body support comprises a grounding support hinge with a uni-directional pivoting axis.

14. The parking indicator of claim 1 wherein the pivoting contact body support comprises a mechanical stop that is configured to limit pivoting between the vertically and horizontally-oriented positions.

15. The parking indicator of claim 1 wherein the elongated visibility indicator comprises a flag.

16. The parking indicator of claim 1 wherein the indicator actuating mechanism comprises a spring.

17. The parking indicator of claim 1 wherein the indicator actuating mechanism is configured to return the elongated visibility indicator to the extended position from the retracted position when the vehicle contact body pivots from the horizontally-oriented position to the vertically-oriented position.

18. The parking indicator of claim 1 wherein the indicator actuating mechanism is configured to keep the indicator retraction mechanism in tension as the vehicle contact body pivots from the horizontally-oriented position to the vertically-oriented position and enables the elongated visibility indicator to retract when the vehicle contact body pivots from the vertically-oriented position to the horizontally-oriented position.

19. A parking indicator comprising:

a vehicle contact body;

a pivoting contact body support;

an elongated visibility indicator;

an indicator actuating mechanism; and an indicator retracting mechanism, wherein the pivoting contact body support is attached to the vehicle contact body and is configured to permit the vehicle contact body to pivot to a horizontally-oriented position when the vehicle contact body is grounded via the pivoting contact body support and is contacted by a vehicle entering a parking space occupied by the parking indicator, the vehicle contact body comprises a housing that encloses the indicator retracting mechanism and a vehicle contact face comprising a vehicle contact point free of obstructive discontinuities that is configured to yield to contact pressure when contact with a vehicle causes the vehicle contact body to move from a vertically-oriented position to the horizontally-oriented position, the pivoting contact body support and the vehicle contact body collectively define a grounded contact body height h that is sufficient to ensure that a vehicle moving across a parking indicator position will contact the vehicle contact body when the vehicle contact body is grounded via the pivoting contact body support in the vertically-oriented position, the elongated visibility indicator is mechanically coupled to the vehicle contact body via the indicator actuating mechanism such that the indicator actuating mechanism upholds the elongated visibility indicator in an extended position, at a height that it is sufficient for substantially unobstructed vehicular viewing when the vehicle contact body is grounded via the pivoting contact body support in the vertically-oriented position, the indicator actuating mechanism comprises a spring and is configured to keep the indicator retraction mechanism in tension as the vehicle contact body pivots from the horizontally-oriented position to the vertically-oriented position and enables the elongated visibility indicator to retract when the vehicle contact body pivots from the vertically-oriented position to the horizontally-oriented position, the indicator retracting mechanism comprises a retraction pulley mechanically coupled to the vehicle contact body, an indicator displacement mass, and a tensile retracting link, the indicator displacement mass is mechanically coupled to the elongated visibility indicator via the tensile retracting link, the tensile retracting link undergoes a directional tensile force transfer at the retraction pulley so as to define a folded tensile path extending from the indicator displacement mass to the elongated visibility indicator, the parking indicator comprises a displacement mass guide mechanically coupled to the vehicle contact body such that the displacement mass guide and the vehicle contact face of the vehicle contact body are non-parallel and define an angle of declination there between, and the indicator retracting mechanism retracts the elongated visibility indicator from the extended position to a retracted position when the vehicle contact body pivots from the vertically-oriented position to the horizontally-oriented position.

* * * * *